US010837253B2

(12) United States Patent
Atkins et al.

(10) Patent No.: US 10,837,253 B2
(45) Date of Patent: Nov. 17, 2020

(54) PRESSURE CONTROL DEVICE

(71) Applicant: Rubberatkins Limited, Aberdeenshire (GB)

(72) Inventors: Nick Atkins, Aberdeenshire (GB); Craig Spalding, Aberdeenshire (GB); Vijay Avanashiappan, Aberdeenshire (GB)

(73) Assignee: RUBBERATKINS LIMITED, Aberdeenshire (GB)

( * ) Notice: Subject to any disclaimer, the term of this patent is extended or adjusted under 35 U.S.C. 154(b) by 257 days.

(21) Appl. No.: 15/531,274

(22) PCT Filed: Nov. 30, 2015

(86) PCT No.: PCT/GB2015/053651
§ 371 (c)(1),
(2) Date: May 26, 2017

(87) PCT Pub. No.: WO2016/083846
PCT Pub. Date: Jun. 2, 2016

(65) Prior Publication Data

US 2017/0342796 A1 Nov. 30, 2017

(30) Foreign Application Priority Data

Nov. 28, 2014 (GB) ..... 1421152.8

(51) Int. Cl.
*E21B 33/12* (2006.01)
*E21B 33/126* (2006.01)
(Continued)

(52) U.S. Cl.
CPC ..... *E21B 33/1208* (2013.01); *E21B 33/126* (2013.01); *E21B 37/10* (2013.01);
(Continued)

(58) Field of Classification Search
CPC ..... E21B 33/1208; E21B 33/126; E21B 33/1212; E21B 33/1285; E21B 33/128; E21B 33/12; E21B 37/00; E21B 37/10
See application file for complete search history.

(56) References Cited

U.S. PATENT DOCUMENTS 2,305,282 A * 12/1942 Taylor, Jr. ..... E21B 37/10 166/202
2,723,721 A * 11/1955 Corsette ..... E21B 33/126 138/118

(Continued)

OTHER PUBLICATIONS

International Preliminary Report on Patentability dated Jun. 8, 2017 for corresponding International Application No. PCT/GB2015/053651.

(Continued)

*Primary Examiner* — Yong-Suk (Philip) Ro
(74) *Attorney, Agent, or Firm* — Tarolli, Sundheim, Covell & Tummino LLP

(57) ABSTRACT

A pressure control device for sealing a conduit comprises a seal element comprising an elastomer, the seal element defining a seal element external surface portion, the seal element external surface portion defining an external perimeter. The external perimeter is adapted to increase as an environmental temperature increases, such that, in use, an increase in the environmental temperature can move the seal element external surface portion into engagement with the conduit or, once engaged with the conduit or if already engaged with the conduit, can create an improved seal with the conduit.

18 Claims, 6 Drawing Sheets

(51) Int. Cl.
*E21B 37/10* (2006.01)
*E21B 33/128* (2006.01)

(52) U.S. Cl.
CPC ..... *E21B 33/128* (2013.01); *E21B 33/1212* (2013.01); *E21B 33/1285* (2013.01)

(56) References Cited

U.S. PATENT DOCUMENTS

| | | | | |
|---|---|---|---|---|
| 4,424,865 | A | 1/1984 | Payton, Jr. | |
| 7,347,274 | B2 * | 3/2008 | Patel | E21B 33/128 166/120 |
| 2004/0194970 | A1 | 10/2004 | Eatwell | |
| 2007/0240877 | A1 | 10/2007 | O'Malley et al. | |
| 2011/0139466 | A1 | 6/2011 | Chen et al. | |
| 2013/0263929 | A1 * | 10/2013 | Atkins | E21B 33/1208 137/12 |

OTHER PUBLICATIONS

International Search Report and Written Opinion for corresponding PCT Application No. PCT/GB2015/053651.

* cited by examiner

PRESSURE CONTROL DEVICE

FIELD OF THE INVENTION

The present invention relates to a pressure control device for modulating pressure in a portion of a conduit.

BACKGROUND OF THE INVENTION

In the oil and gas exploration and extraction industries it is often desirable to be able to modulate downhole pressure when required. For example, it is desirable to isolate a section of well bore to create sections of differential pressure within the bore. A sealing device is used to create a seal within the bore, such that fluid pressure on one side of the seal increases relative to fluid pressure on the other side. Further, a temporary decrease in well pressure can be used to initiate flow from the reservoir in a process known as 'swabbing'. One means of doing this is to make use of a swab cup, which is a cup-shaped resilient member which is lowered on a mandrel into the well. As a pressure differential develops across the cup, the walls of the cup are pushed into contact with the well tubing or bore wall, thereby sealing a portion of the well. Thus, the pressure below the cup may decrease, while the pressure above may increase.

Similarly-constructed pressure cups are also used in a wide variety of other sealing and fluid lifting applications. For example, variations in pressure may also be used to actuate or to control other downhole tools and instruments which rely on fluid pressure for their operation. Conventional cups is constructed with an outer diameter slightly larger than that of the bore, such that a seal is present even when the cup is not inflated. Conventional pressure cups suffer from a number of disadvantages. For example, as the cup is constructed with an outer diameter slightly larger than the diameter of the bore, the cup will rub against the bore as it is run-into position. This can wear the cup and may affect the formation of a seal between the cup and the bore wall. Furthermore, if the bore has restrictions which narrow the width of the bore, it may not be possible to pass the restriction without damaging the pressure cup and an alternative sealing mechanism is required.

SUMMARY OF THE INVENTION

According to a first aspect of the present invention, there is provided a pressure control device for sealing a conduit, the pressure control device comprising:

a seal element comprising an elastomer, the seal element defining a seal element external surface portion, the seal element external surface portion defining an external perimeter, the external perimeter adapted to increase as an environmental temperature increases, such that, in use, an increase in the environmental temperature can move the seal element external surface portion into engagement with the conduit or, once engaged with the conduit or if already engaged with the conduit, can create an improved seal with the conduit.

In at least one embodiment of the present invention, a pressure control device as described above is capable of being introduced and/or run in a conduit with ease and without the outer perimeter of the pressure control device being damaged and is simultaneously able to form a seal against the conduit when it is located at a desired depth by an increased environmental temperature or causing the environmental temperature at the desired depth to increase.

In at least one alternative embodiment of the present invention, a pressure control device as described above is capable of being introduced and/or run in a conduit in contact with the conduit and is able to form an improved or tighter seal against the conduit when it is located a desired depth by an increased environmental temperature or by causing the environmental temperature at the desired depth to increase.

Where the seal element is a cup seal having a circular cross-section, the external perimeter may define the maximum external diameter.

The seal element external surface portion may be adapted to decrease its external diameter as an environmental temperature decreases, such that, in use, a decrease in temperature can disengage the seal element external surface portion from the conduit or, if the seal element external surface portion is still engaged with the conduit, can reduce the seal tightness between the seal element external surface portion and the conduit.

In at least one embodiment of the present invention, when the seal element can disengage or reduce its seal with the conduit upon a reduction in environmental temperature, it is possible to translate the pressure control device within the conduit, or remove the pressure control device from the conduit, at will and with ease by simply causing the temperature in the surroundings of the pressure control device to drop.

Therefore, the pressure control device can be in a run-in configuration, in which when subjected to a predetermined temperature, for example, the seal element either engages with the conduit of forms a tighter seal with the conduit. The pressure control device can also be in a sealed configuration in which, when subjected to a predetermined temperature the seal between the seal element and the conduit weakens or the seal element disengages from the conduit The pressure control device may comprise a deformable support element embedded in the seal element, the support element defining a plurality of voids, the elastomer adapted to permeate into the voids.

In at least one embodiment of the present invention a pressure control device is provided which can expand to form a tight seal with a conduit internal surface. Providing a deformable support element into which the elastomer can permeate, provides structure to the pressure control device element and assists in controlling the deformation of the pressure control device element when moving from the run-in position to the sealed position.

The conduit surface could be defined by a wellbore or a well tubular. In other alternatives, the conduit surface could be the internal surface of a tubular of any description.

The support element may be embedded in a seal element external surface. In moving from the run-in position to the sealed position, the seal element may expand radially outwards.

In at least one embodiment, by expanding radially outwards, the seal element presses against the support element.

In moving from the run-in position to the sealed position, the seal element applies a deformation force to the support element.

Additionally, the seal element may be adapted to pass from the run-in configuration to the sealed configuration under the influence of a second environmental condition.

The second environmental condition may be an environmental pressure. It will be understood that the first environmental condition is the environmental temperature.

The environmental condition may be present in the conduit such as conduit temperature or conduit pressure.

Alternatively or additionally, the environmental condition may be induced in the pressure control device.

The conduit temperature may induce thermal expansion on the seal element.

Alternatively or additionally, the pressure control device may further comprise a temperature control mechanism adapted to raise or lower the temperature of the seal element.

Additionally, the seal element may be adapted to pass from the run-in configuration and the sealed configuration under an applied pressure.

The pressure control device may further comprise a pressure application mechanism adapted to apply a pressure to the seal element to move the seal element to the sealed position.

The seal element may define a contact portion adapted to engage, in use, the conduit surface to form a seal in the sealed position.

The contact portion may be circumferential.

In the run-in position, the contact portion may define the maximum external diameter of the pressure control device element.

The support element may be located adjacent to the contact portion.

The support element may act as a back-up to the contact portion. By back-up it is meant that the support element supports the contact portion and substantially prevents extrusion of the seal element material towards the low pressure side of the pressure control device.

The seal element may be further adapted to pass from the sealed position to an enhanced sealed position.

In the enhanced sealed position, the seal element contact portion may be engaged with the conduit surface.

Additionally, in the enhanced sealed position, a further portion of the seal element may be pressed into engagement with the conduit surface by the support element.

Alternatively or additionally, in the enhanced sealed position, the support element contact portion may be engaged with the conduit surface.

The seal element may be adapted to pass from the sealed position to the enhanced sealed position by thermal expansion.

Alternatively or additionally the seal element may be adapted to pass from sealed position to the enhanced sealed position under an applied pressure.

The seal element may be adapted to pass from the sealed position to the enhanced sealed position by an environmental pressure acting on a seal element internal surface. Once the seal element is in the sealed position, pressure behind the seal element can build causing a pressure differential across the pressure control device. This pressure differential creates a force on the internal surface of the seal element pressing the seal element into tighter engagement with the surface and pressing the support element directly into engagement with the conduit surface or causing the support element to press layer of elastomer which may be covering the support element into engagement with the conduit surface.

The support element may comprise a plurality of element layers. Having multiple layers allows adjacent layers to move with respect each other as the support element deforms.

Each element layer may define at least one aperture.

The element layers may be overlapping.

There may be a plurality of apertures defined by each element layer.

Where there is a plurality of apertures, at least some apertures on adjacent layers may be partially aligned. Partial alignment of the apertures in adjacent layers is desirable because at least partial permeation of the support element by the elastomer is advantageous as this increases the support that the support element can give the seal element as it is, to an extent, integral with the seal element. However, full alignment of the apertures in adjacent layers is less desirable as full alignment creates an extrusion path through the support element for the elastomer to pass through when particularly under pressure, thereby reducing the support effect of the support element.

The support element may comprise a multi-layered mesh.

The support element may comprise a metal.

The support element may comprise a garter spring.

Alternatively or additionally the support element may comprise a polymer.

The support element may comprise a plastic.

In further alternatives the support element may comprise at least one overlapping grid.

In still further alternatives the support element may comprise a woven material.

The woven material may be Kevlar.

The support element may be conical.

Particularly the support element may be frusto-conical.

The support element may alternatively be cylindrical or any suitable shape.

The support element may comprise multiple layers of woven material.

The seal element may be a cup.

The pressure control device may further comprise a seal holder.

The support element may be located between the seal element and the seal holder.

According to a second aspect of the present invention there is provided a method of sealing a conduit, the method comprising the steps of:

providing a pressure control device in a portion of conduit to be sealed, the pressure control device comprising a seal element, defining a seal element external surface portion, the seal element external surface portion defining an external perimeter, the external perimeter adapted to increase as an environmental temperature increases, such that, in use, an increase in the environmental temperature can move the seal element external surface portion into engagement with the conduit or, once engaged with the conduit or if already engaged with the conduit, can create an improved seal with the conduit;

subjecting the seal element to an environmental temperature increase such that the seal element forms a sealing engagement with a conduit surface.

The method may comprise the step of measuring or estimating the environmental temperature at a conduit depth where a seal is to be formed and adjusting the outside perimeter of the seal element such that the seal element forms a seal with the conduit at the conduit depth where a seal is to be formed.

The method may comprise pumping fluids within the conduit at a temperature such that the seal element forms a seal with the conduit.

The method may comprise pumping fluids within the conduit at a temperature such that the seal element contracts when the pressure control device is to be removed.

Embodiments of the second aspect of the invention may comprise embodiments and/or features of the first aspect of the invention and/or vice versa.

According to a third aspect of the present invention, there is provided a pressure control device for sealing a conduit, the pressure control device comprising:

a seal element comprising an elastomer, the seal element adapted to move between a run-in position and a sealed position, in the sealed position the seal element adapted to form a seal with a conduit internal surface; and a deformable support element embedded in the seal element, the support element defining a plurality of voids, the elastomer adapted to permeate into the voids.

Embodiments of the third aspect of the invention may comprise embodiments and/or features of the first and/or second aspect of the invention and/or viceversa.

According to a fourth aspect of the invention there is provided a pressure control device for sealing a conduit, the pressure control device comprising a seal element comprising an elastomer, the seal element defining a seal element external surface portion, the seal element external surface portion defining an external perimeter, the external perimeter adapted to increase as an environmental temperature increases, such that, in use, an increase in the environmental temperature can move the seal element external surface portion into engagement with the conduit.

Embodiments of the fourth aspect of the invention may comprise embodiments and/or features of the first, second and or third aspects of the invention and/or vice versa.

According to a fifth aspect of the invention there is provided a pressure control device for sealing a conduit, the pressure control device comprising a seal element comprising an elastomer, the seal element defining a seal element external surface portion, the seal element external surface portion defining an external perimeter, the external perimeter adapted to increase as an environmental temperature increases, such that, in use, an increase in the environmental temperature can create an improved (tighter) seal between the seal element external surface portion and the conduit where the seal element external surface portion is already engaged with the conduit.

Embodiments of the fifth aspect of the invention may comprise embodiments and/or features of the first, second, third and/or fourth aspects of the invention and/or vice versa.

In at least one embodiment of the present invention, a pressure control device that has an initial minimal interference fit with a conduit can be run in the conduit easily and still create a tighter seal in a desired conduit location when the temperature of the seal element causes it to exert a greater force against the conduit walls, thereby creating a tighter and/or more permanent seal.

According to a sixth aspect of the present invention there is provided a method of sealing a conduit, the method comprising the steps of:

providing a pressure control device in a portion of conduit to be sealed, the pressure control device having a seal element comprising elastomer and a deformable support element embedded in the seal element, the support element defining a plurality of voids, the elastomer adapted to permeate into the voids;

subjecting the seal element to a temperature high enough to induce thermal expansion in the seal element such that a seal element portion forms a sealing engagement with a conduit surface.

BRIEF DESCRIPTION OF THE DRAWINGS

An embodiment of the present invention will now be described with reference to the accompanying Figures in which.

DETAILED DESCRIPTION OF THE DRAWINGS

Figure 1:
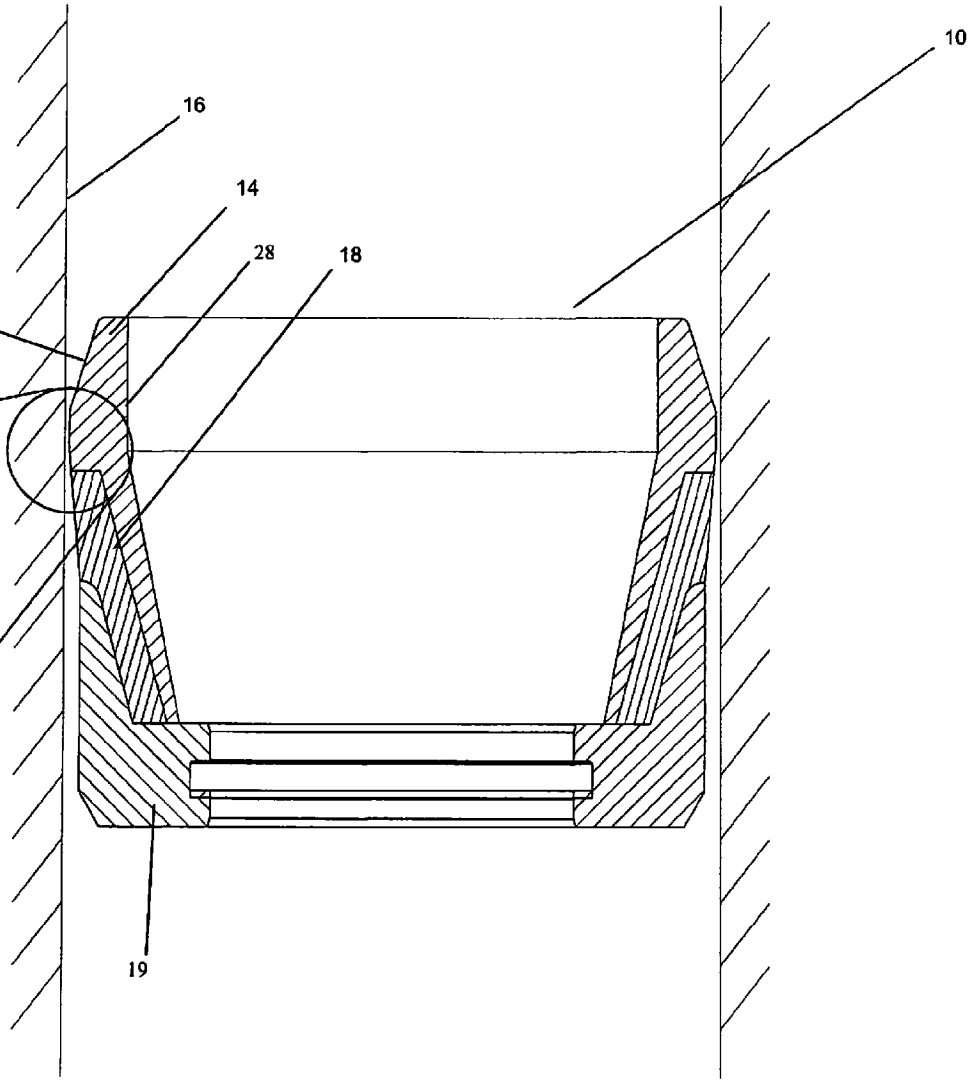
FIG. 1 is a section of a pressure control device for sealing a conduit in a run-in position according to an embodiment of the present invention.

Reference is first made to FIG. 1, a section of a pressure control device, generally indicated by reference numeral 10, for sealing a conduit 12, according to a first embodiment of the present invention. In FIG. 1, the pressure control device 10 is shown in a run-in position.

Figures 3, 3A:
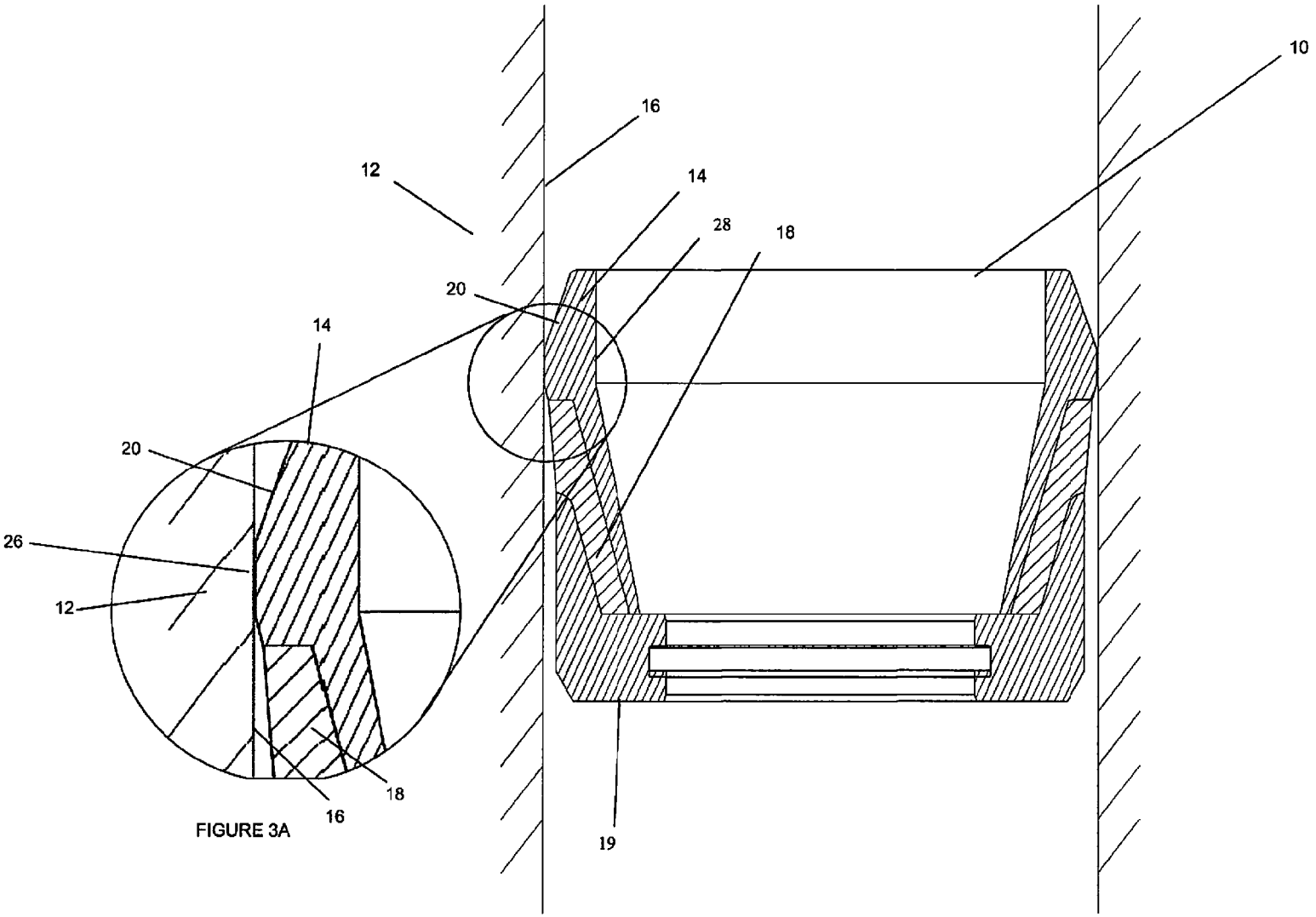
FIG. 3 is a section of the pressure control device of FIG. 1 shown in a sealing position.
FIG. 3A is a close-up of part of the pressure control device FIG. 3.
Figures 4, 4A:
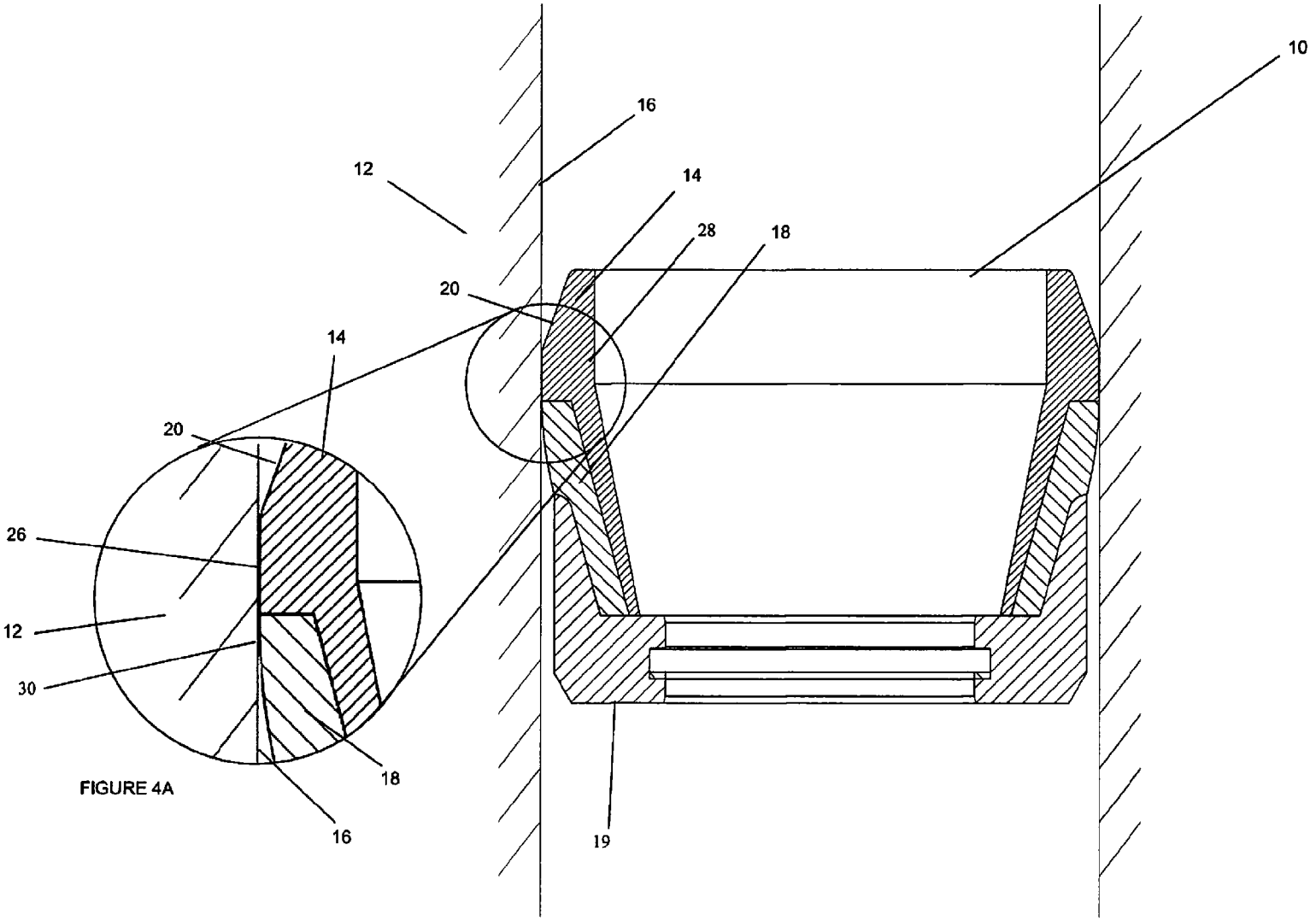
FIG. 4 is a section of the pressure control device FIG. 1 shown in an enhanced sealed position.
FIG. 4A is a close-up of part of the pressure control device of FIG. 4.

The pressure control device 10 comprises an elastomeric seal element 14 adapted to move between the run-in position shown in FIG. 1 and a sealed position (shown and discussed in due course in connection with FIG. 3) and an enhanced sealed position (shown in discussed in due course in connection with FIG. 4).

Figure 1A:
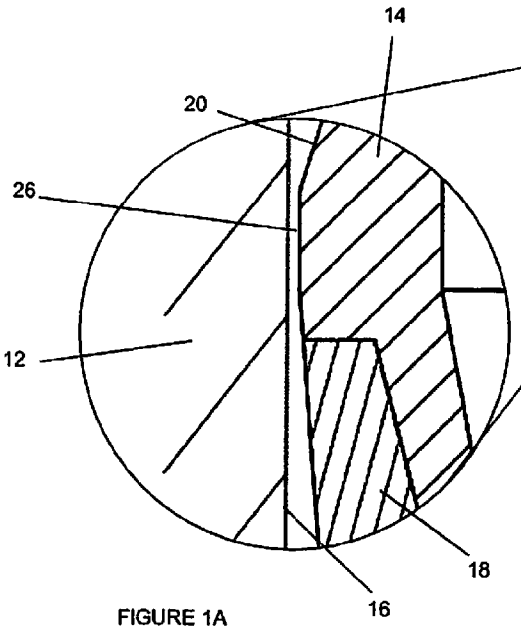
FIG. 1A is a close-up of part of the pressure control device of FIG. 1.

In the run-in position, as best shown in FIG. 1A, there is a gap between the seal element 14 and a conduit internal surface 16. This gap allows the pressure control device 10 to be run-into the conduit 12 with minimal damage to the seal element 14 which could be caused by the seal element 14 scraping against the conduit internal surface 16.

The pressure control device 10 further comprises a seal element holder 19 and a deformable support element 18. The deformable support element 18 is embedded in the seal element 14. Particularly the support element 18 is embedded in the seal element external surface 20.

Figures 2, 2A:
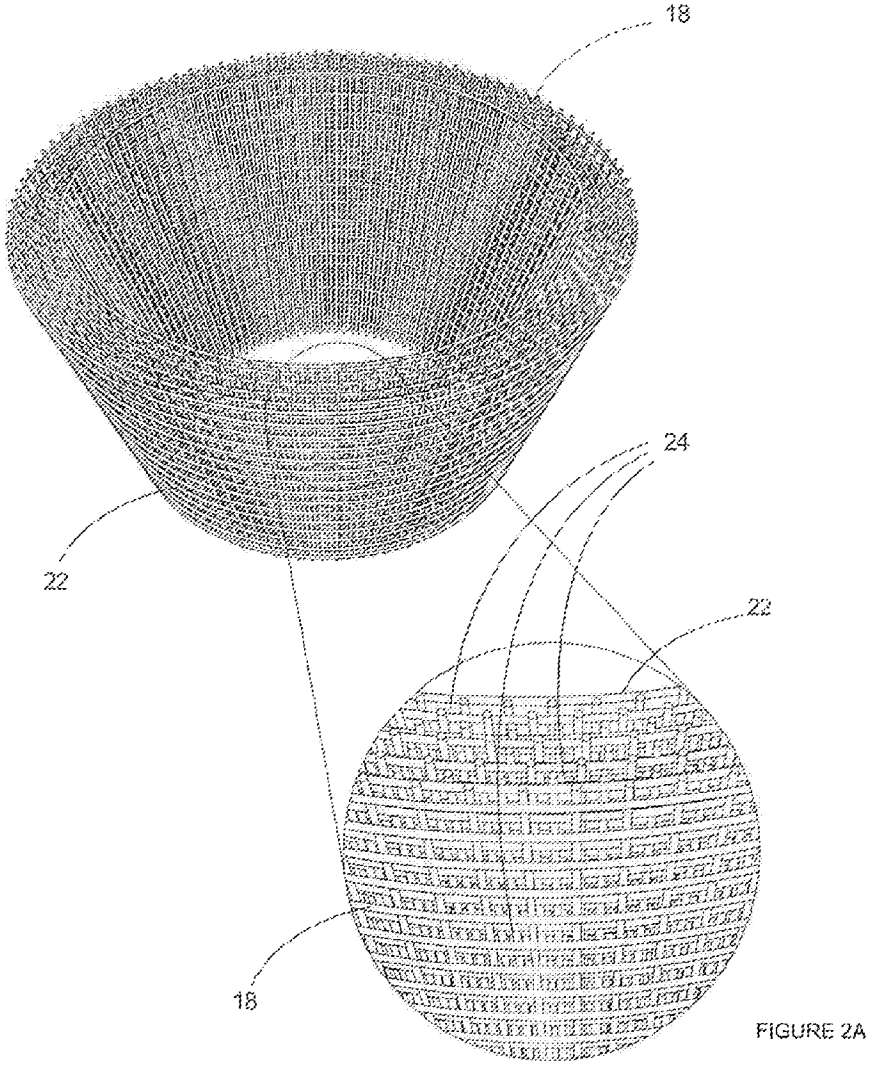
FIG. 2 is a perspective view of the support element of the pressure control device of FIG. 1.
FIG. 2A is a close-up of part of the support element of FIG. 2.

FIG. 2 shows a perspective view of the deformable support element 18 and FIG. 2A shows a close-up of part of the support element 18. The support element 18 is frustoconical in shape and is made from a length of steel mesh 22 wrapped around a former (not shown) around forty to fifty times.

As can be seen from FIG. 2A, the steel mesh 22 defines voids 24. Between adjacent layers of mesh 22 there is partial but not complete alignment of the voids 24 through the support element 18. The reason for this partial alignment will now be discussed.

The elastomer of the seal element 14 is adapted to permeate into the support element voids 24. This primarily happens when the seal element 14 is at an elevated temperature, greater than normal room temperature. Some permeation will occur during manufacture as the support element 18 is embedded in the seal element 14 as the seal element 14 is pressure formed around the support element 18.

Further permeation occurs as the pressure control device 10 moves from the run-in position shown in FIG. 1 to the sealed and enhanced sealed positions shown in FIGS. 3 and 4 respectively.

The pressure control device 10 is adapted to utilise the thermal expansion properties of the elastomeric seal element 14 to create a seal with the conduit internal surface 16. If the temperature in the conduit 12 is sufficiently high the temperature will create a radial expansion force within the seal element 14. The support element 18 is designed to resist the expansion force, causing the elastomeric seal element 14 to further permeate into the support element voids 24. This further engagement between the seal element 14 and support element 18 increases the pressure on the support element 18 and the support element 18 will start to deform, allowing a circumferential seal element contact portion 26 into engagement with the conduit internal surface 16.

Once the circumferential contact portion 26 is engaged with the conduit internal surface 16 the seal is formed and the seal element 14 is in the sealed position. This position shown in FIG. 3 and FIG. 3A.

With the seal formed, pressure will start to build up inside the seal element 14 and act on the seal element internal surface 28. This provides further permeation of the seal element elastomer into the support element voids 14 and creates greater pressure on the seal element 14 itself. The action of this internal pressure forces the support element 18 to deform further and brings a support element contact surface 30 into engagement with the conduit internal surface 16, this is the enhanced sealed position shown in FIG. 4 and FIG. 4A.

The pressure on the seal element 14 at these elevated temperatures try to force the pliable elastomer towards a low-pressure side of the pressure control device 10. However, the support element contact surface 30 is continuous and prevents extrusion of the seal element 14 down the conduit internal surface 16 towards the seal element holder 19. Furthermore, it is believed this continuous contact surface 30 prevents fluting of the conduit internal surface 16 if the pressure control device moves within the conduit 14 which may occur with other back-up systems.

The mesh layers of the support element 18, whilst cooperating to define voids 24 for the elastomer to permeate into, are only partially aligned to minimise the opportunity for the elastomer to permeate the whole way through the support element 18 and create an extrusion path through the support element 18.

Figure 5:
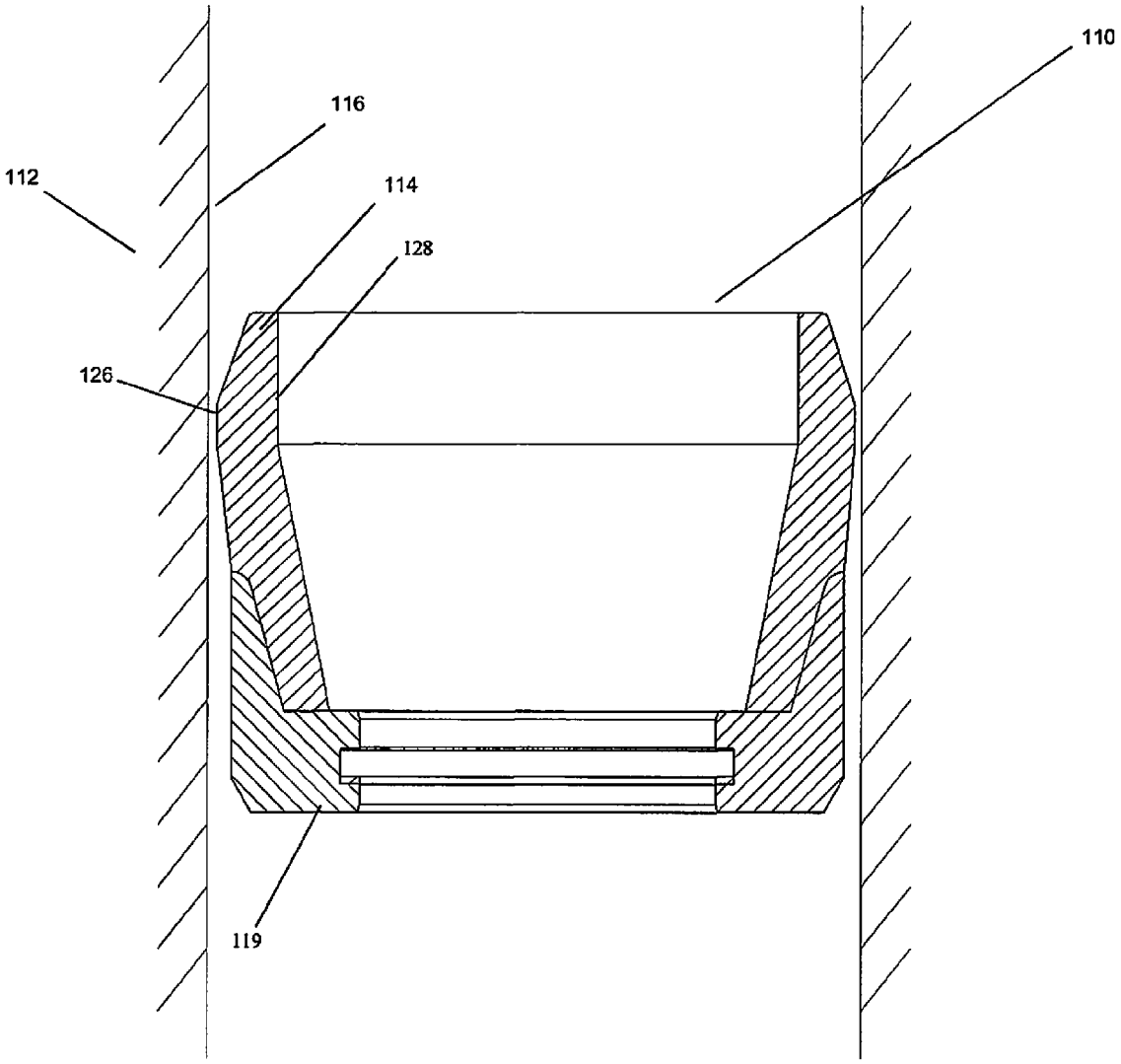
FIG. 5 is a section of an alternative pressure control device for sealing a conduit in a run-in position.

Reference is now made to FIG. 5, a section of a pressure control device, generally indicated by reference numeral 110, for sealing a conduit 112, according to a second embodiment of the present invention. In FIG. 5, the pressure control is device 110 shown in a run-in position.

The pressure control device 110 is identical to the pressure control device 10 of the first embodiment with the exception that the control device 110 of the second embodiment does not incorporate a deformable support element 18.

Figure 6:
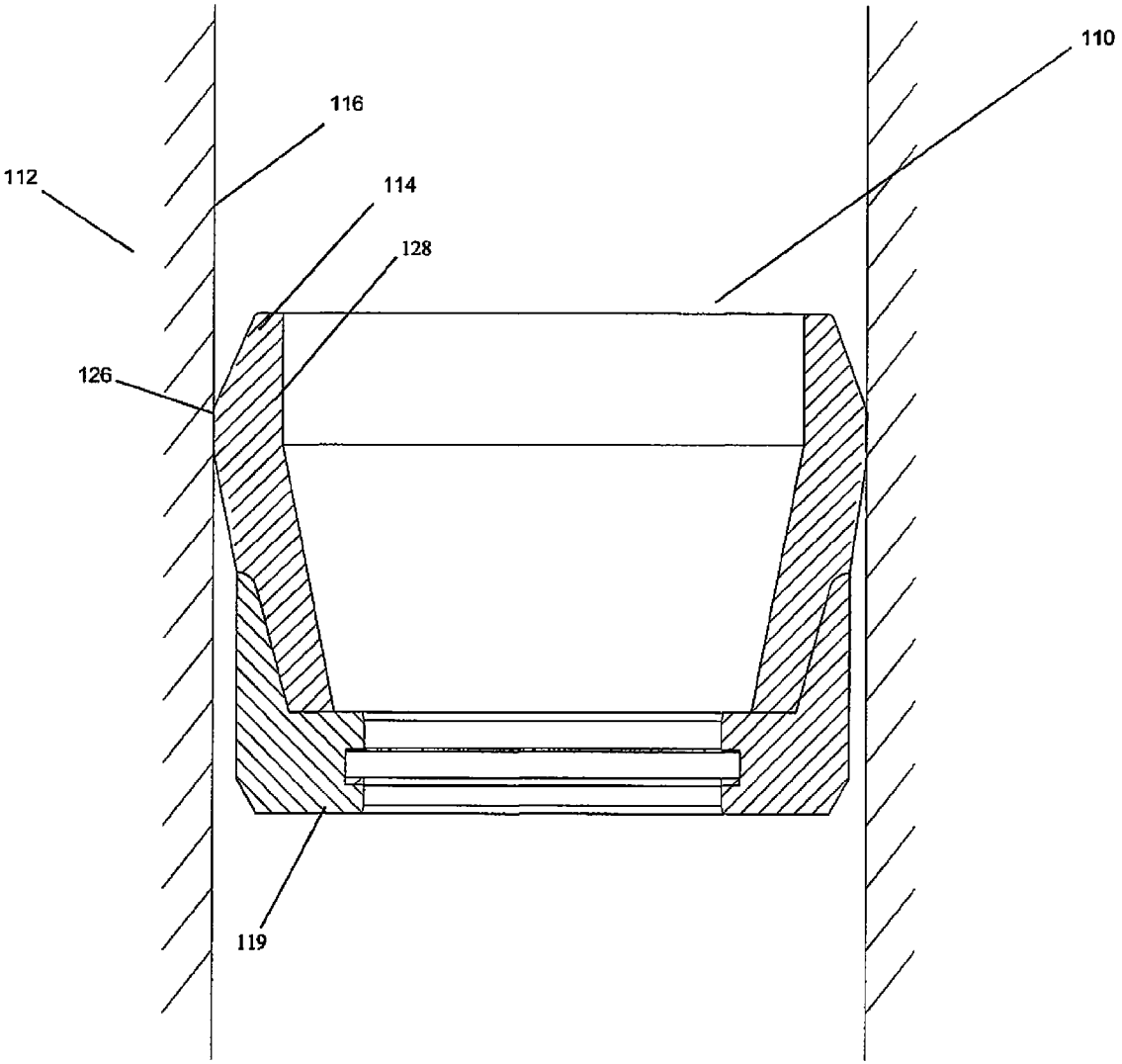
FIG. 6 is a section of the prpessure control device of FIG. 5 showing the device in an enhanced sealed position.

The pressure control device 110 comprises an elastomeric seal element 114 adapted to move between the run-in position shown in FIG. 5 through a sealed position to an enhanced sealed position (shown in discussed in due course in connection with FIG. 6).

In the run-in position, there is a gap between the seal element 114 and a conduit internal surface 116. This gap allows the pressure control device 110 to be run-into the conduit 112 with minimal damage to the seal element 114 which could be caused by the seal element 114 scraping against the conduit internal surface 116.

The pressure control device 110 further comprises a seal element holder 119.

The pressure control device 110 is adapted to utilise the thermal expansion properties of the elastomeric seal element 114 to create a seal with the conduit internal surface 116. The temperature at which engagement occurs can be varied by changing the material or the outside diameter of the elastomeric seal element 114. If the temperature in the conduit 112 is sufficiently high the temperature will create a radial expansion force within the seal element 114.

Once the circumferential contact portion 126 is engaged with the conduit internal surface 116 the seal is formed and the seal element 114 is in the sealed position. With the seal formed, pressure will start to build up inside the seal element 114 and act on the seal element internal surface 128 creating an enhanced sealed position shown in FIG. 6.

Various modifications and improvements may be made to the above-described embodiments without departing from the scope of the invention. For example, in low-temperature environments, a mechanical force could be applied to move the seal element to the sealed position.

Although the support element is shown as being a conical multilayer mesh construction, other materials such as Kevlar could be used and other shapes such a cylindrical can be adopted.

The invention claimed is:

1. A pressure control device for sealing a conduit, the pressure control device comprising:

a seal element comprising an elastomer, the seal element defining a seal element external surface portion, the seal element external surface portion defining an external perimeter, the external perimeter adapted to increase as an environmental temperature increases, such that, in use, an increase in the environmental temperature can move the seal element external surface portion into engagement with the conduit or into improved sealing engagement with the conduit;

wherein the pressure control device is movable between a run-in position, in which at a predetermined increased environmental temperature the seal element either engages with the conduit or forms a tighter seal with the conduit and a sealed position from which, at a predetermined reduced environmental temperature the seal between the seal element and the conduit weakens or the seal element disengages from the conduit;

wherein the pressure control device comprises a deformable support element embedded in the seal element, the support element defining a plurality of voids, the elastomer adapted to permeate into the voids when the environmental temperature increases; and the support element is embedded in a seal element external surface.

2. The pressure control device of claim 1, wherein where the seal element is a cup seal having a circular cross-section, the external perimeter defines the maximum external diameter; and the seal element external surface portion is adapted to decrease in external diameter as an environmental temperature decreases, such that, in use, a decrease in temperature can disengage the seal element external surface portion from the conduit or, can reduce the seal tightness between the seal element external surface portion and the conduit.

3. The pressure control device of claim 1, wherein in moving from the run-in position to the sealed position, the seal element expands radially outwards.

4. The pressure control device of claim 1, wherein in moving from the run-in position to the sealed position, the seal element applies a deformation force to the support element.

5. The pressure control device of claim 1, wherein the seal element is adapted to pass from the run-in configuration to the sealed configuration under the influence of a second environmental condition.

6. The pressure control device of claim 5, wherein the second environmental condition is an environmental pressure.

7. The pressure control device of claim 1, wherein the pressure control device further comprises a temperature control mechanism adapted to raise or lower the temperature of the seal element.

8. The pressure control device of claim 1, wherein the seal element is adapted to pass from the run-in configuration and the sealed configuration under an applied pressure.

9. The pressure control device of claim 8, wherein the pressure control device further comprises a pressure application mechanism adapted to apply a pressure to the seal element to move the seal element to the sealed position.

10. The pressure control device of claim 1, wherein the seal element defines a contact portion adapted to engage, in use, a conduit surface to form a seal in the sealed position.

11. The pressure control device of claim 10, wherein the contact portion is circumferential.

12. The pressure control device of claim 10, wherein the contact portion defines a maximum external diameter of the pressure control device.

13. The pressure control device of claim 1;

wherein the pressure control device comprises a deformable support element embedded in the seal element, the support element defining a plurality of voids, the elastomer adapted to permeate into the voids;

wherein the support element is embedded in a seal element external surface; and wherein the support element is located adjacent to the contact portion.

14. The pressure control device of claim 13, wherein the support element acts as a back-up to the contact portion.

15. The pressure control device of claim 1, wherein the seal element is further adapted to pass from the sealed position to an enhanced sealed position.

16. The pressure control device of claim 15, wherein the seal element defines a contact portion adapted to engage, in use, a conduit surface to form a seal in the sealed position; and wherein in the enhanced sealed position, the seal element contact portion is engaged with a conduit surface.

17. The pressure control device of claim 16;

wherein the pressure control device comprises a deformable support element embedded in the seal element, the support element defining a plurality of voids, the elastomer adapted to permeate into the voids;

the support element is embedded in a seal element external surface; and wherein in the enhanced sealed position, a further portion of the seal element is pressed into engagement with a conduit surface by the support element.

18. A method of sealing and then unsealing a conduit, the method comprising:

providing a pressure control device in a portion of conduit to be sealed, the pressure control device comprising a seal element, defining a seal element external surface portion, the seal element external surface portion defining an external perimeter, the external perimeter adapted to increase as an environmental temperature increases, such that, in use, an increase in the environmental temperature can move the seal element external surface portion into engagement with the conduit or, into improved sealing engagement with the conduit;

subjecting the seal element to an environmental temperature increase such that the seal element forms a sealing engagement or, an improved sealing engagement, with a conduit surface; and then disengaging the seal or reducing the seal to the conduit by subjecting the seal element to an environmental temperature decrease; and wherein the pressure control device further comprises a deformable support element embedded in the seal element, the support element defining a plurality of voids, the elastomer adapted to permeate into the voids when the environmental temperature increases; and the support element is embedded in the seal element external surface.

* * * * *